US005884351A

United States Patent [19]

Tonino

[11] Patent Number: 5,884,351

[45] Date of Patent: Mar. 23, 1999

[54] ANATOMICAL SUPPORT WITH MOISTURE ABSORBING CLAY DISCS

[76] Inventor: Sanna Tonino, 2400 Leiria, Lisbon, Portugal

[21] Appl. No.: 966,159

[22] Filed: Nov. 7, 1997

[51] Int. Cl.[6] ..... A47G 9/00; A47C 27/14; A47C 27/00

[52] U.S. Cl. ..... 5/652.1; 5/636; 5/724; 5/948; 5/638

[58] Field of Search ..... 5/652.1, 636, 690, 5/638, 639, 694, 948, 724, 725, 6

[56] References Cited

U.S. PATENT DOCUMENTS

| | | | |
|---|---|---|---|
| 3,124,812 | 3/1964 | Milton et al. | 5/638 |
| 3,694,831 | 10/1972 | Treace | 5/636 |
| 4,494,261 | 1/1985 | Morrow | 5/636 |
| 4,574,411 | 3/1986 | Yagi | 5/636 |
| 4,680,822 | 7/1987 | Fujino et al. | 5/948 |
| 5,007,119 | 4/1991 | Yamaguchi | 5/655 |
| 5,152,019 | 10/1992 | Hirata | 5/636 |
| 5,546,618 | 8/1996 | Beedy et al. | 5/725 |
| 5,561,879 | 10/1996 | Everall | 5/725 |

FOREIGN PATENT DOCUMENTS

| | | | |
|---|---|---|---|
| 2949282 | 6/1981 | Germany | 5/636 |
| 4-276217 | 10/1992 | Japan | 5/948 |

*Primary Examiner*—Alex Grosz
*Attorney, Agent, or Firm*—Locke Reynolds

[57] ABSTRACT

This invention relates to a pillow (1) and a mattress (6) the anatomical shape and rigidity of which help to combat pathological lordosis of the forward convex curvature particular to the cervical region and spondylitis in the dorsal region of the vertical column. The pillow (1) consists of two rounded lobes (2) and (3) with an anatomical shape for resting the head when the body is lying down in an antero-posterior position. The mattress is rectangular in shape and its anatomical shape and rigidity allow for perfect posture of the vertebral column in a dorsal or lateral recumbent position, thus guaranteeing decompression of the vertebral discs, which is an essential factor for combating spondylitis. Both are essentially made of a latex-type polyurethane foam the rigidity of which is designed not to affect or alter the pressure of mainly the cervical and dorsal blood vessels, and inside they contain a suitable number of clay discs (4) in pre-defined positions, which are connected to the outside by means of three vertical holes (5). These discs create absorbent and healing conditions owing to the properties of the clay.

11 Claims, 3 Drawing Sheets

ANATOMICAL SUPPORT WITH MOISTURE ABSORBING CLAY DISCS

This invention relates to an anatomically-shaped pillow which helps to combat pathological lordosis of the forward convex curvature particular to the cervical region, and a mattress whose anatomical shape and rigidity allow for perfect posture of the vertebral column in a dorsal or lateral recumbent position, thus guaranteeing decompression of the vertebral discs, which is an essential factor for combating spondylitis. The pillow consists of two rounded lobes with an anatomical shape for resting the head when the body is lying down in an antero-posterior position. The mattress is rectangular in shape. Both are essentially made of a latex-type polyurethane foam the rigidity of which is designed not to affect or alter the pressure of mainly the cervical and dorsal blood vessels, and inside they contain clay discs in pre-defined positions (three for the pillow and sixty-five or forty-five for the single and double mattress respectively), which are connected to the outside by means of three vertical holes. These discs create absorbent and healing conditions owing to the properties of the clay.

Various pillows are already known with shapes that are adapted to the cervical curvature and thus in principle allow for a more correct position for sleeping. However, the pillows belonging to prior art either become deformed as time goes by or are not rigid enough and therefore do not totally resolve the inconveniences caused by incorrect anatomical positioning during sleep. Furthermore, the known pillows are not waterproof or absorbent and they certainly do not have any healing properties.

Thus, one of the objectives of this invention is to design a pillow with a rigid, anatomical shape which is designed not to lose its shape with time and is simultaneously waterproof and can absorb sweat, as well as having healing properties.

Likewise, various type of mattresses exist. However, no mattresses are known which have clay discs inside that are connected to the outside by means of holes. Thus, an object of this invention is to provide an anatomical member support such as a pillow or mattress containing clay discs inside that are connected to the outside by means of holes.

Another objective of this invention is to design a mattress with a rigid, anatomical shape which is designed not to lose its shape with time and is simultaneously waterproof and can absorb sweat, as well as having healing properties.

To give a better understanding of this invention, a sheet of drawings is attached hereto by way of a non-restrictive example and shows the following:

Figure 1:
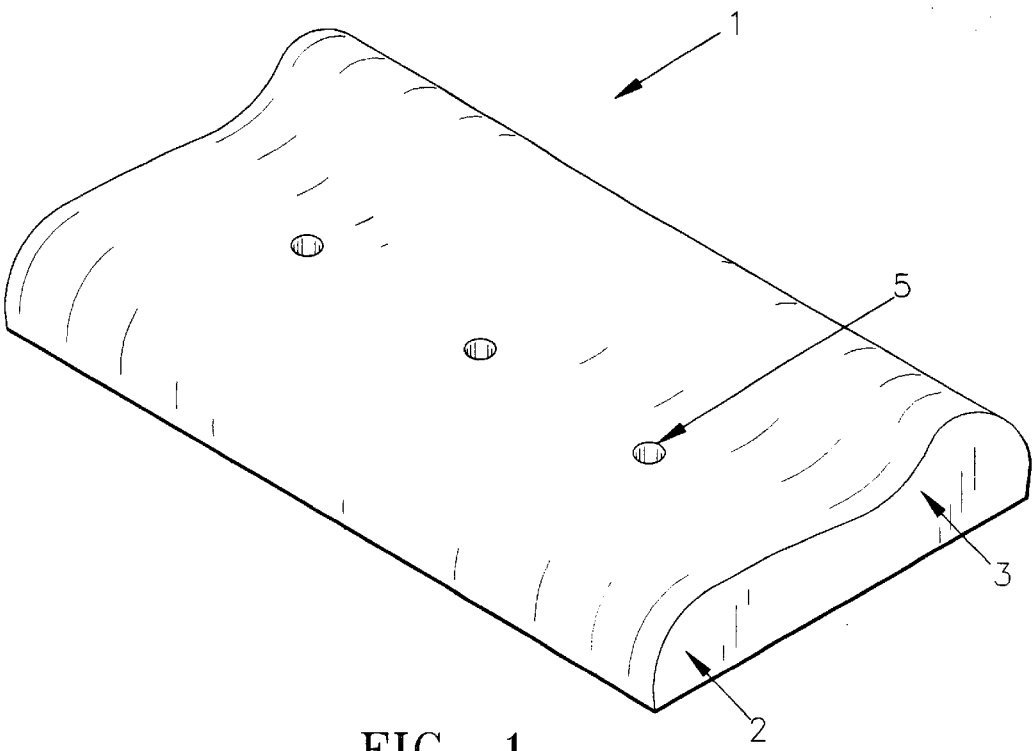
FIG. 1 shows a perspective view of the pillow which is the subject of the invention.

As shown in the figures attached hereto, the pillow (1) with a flat base consists of two lobes (2) and (3) which have the anatomical shape of the cervical head region of the human body. Lobe (3) is larger and must be used to support the aforementioned cervical area, though lobe (2) can be used for this purpose, depending on the dimensions and the cervical curvature. During the manufacturing process, three clay discs (4) are placed inside the pillow, as explained below, which are connected to the outside by means of holes or ventilation channels (5).

Figure 2:
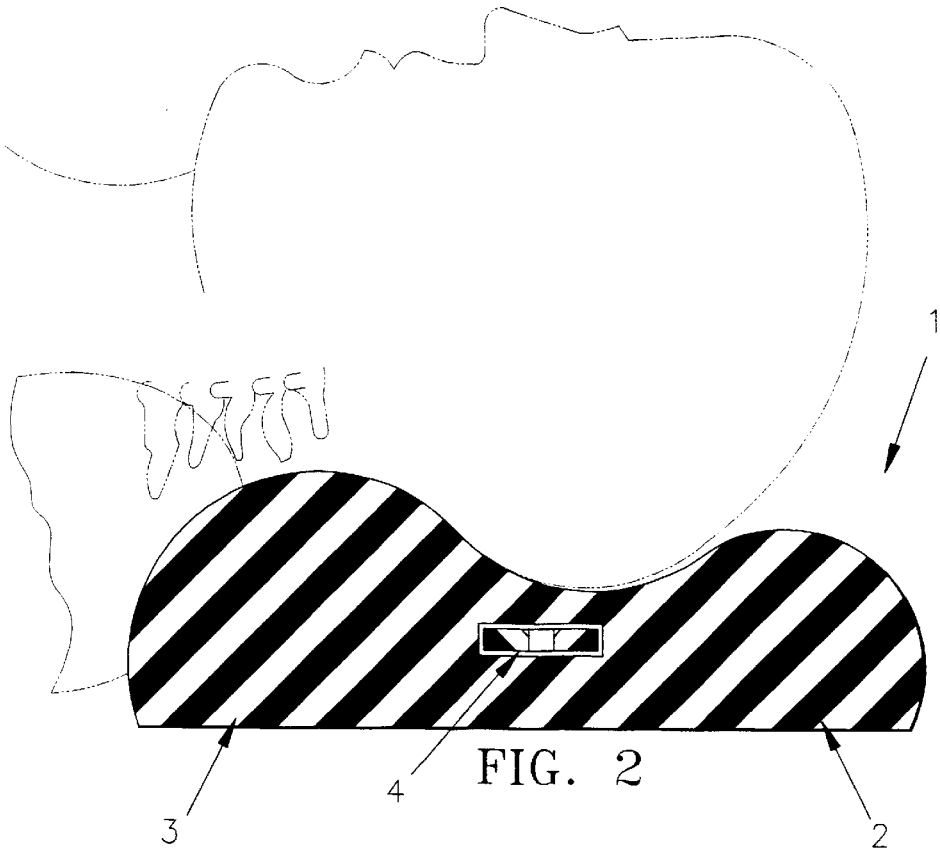
FIG. 2 is a side elevation of the same pillow in use.
Figure 3:
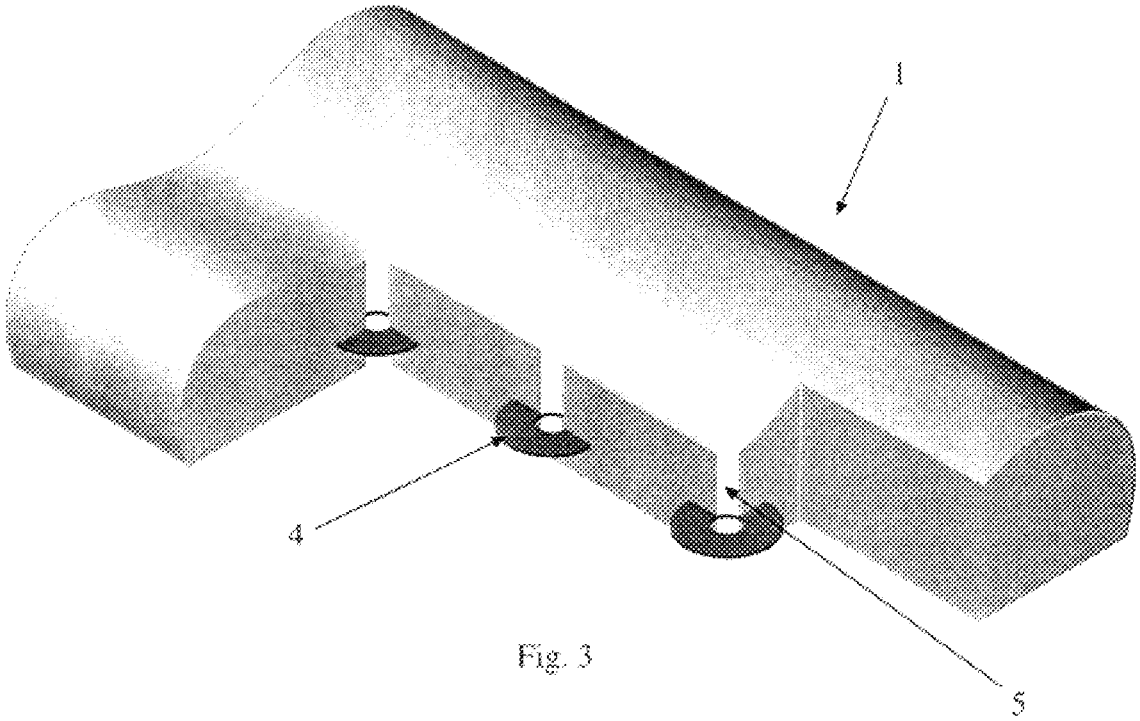
FIG. 3 is a cross-section of the pillow shown in the preceding figures.

As shown in FIG. 2, the anatomical shape of this pillow, which is designed with a rigidity that does not alter the pressure of the blood vessels in the cervical region, avoids the progressive reduction of the space between the vertebrae and causes the decompression thereof. Furthermore, as a result of the raw material used in the manufacturing process and in view of the manufacturing process itself, which will be described below, the surface of the pillow which is the subject of the invention has an insulating film so that natural sweat is not absorbed by the pillow itself but is channelled instead through the holes or channels (5) to the clay discs, which are highly absorbent. As well as this capacity to absorb sweat, the clay discs (4) also have healing properties. In fact, the healing properties of clay are already known, for example antiseptic, anti-inflammatory and cellular regeneration properties. The proximity of the clay discs in relation to the head when lying down on the pillow means that these properties are applied.

Figure 4:
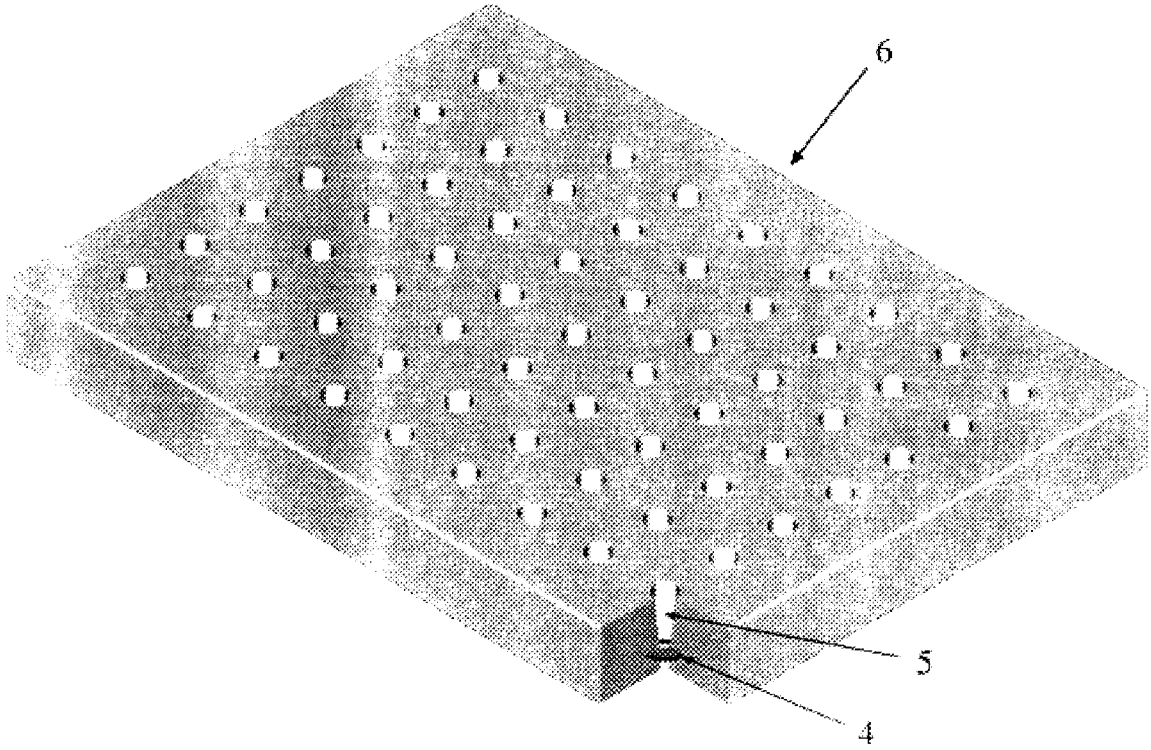
FIG. 4 is a perspective view of the mattress which is the subject of the invention.

The mattress (6) shown in FIG. 4 is rectangular in shape and, as explained below, clay discs (4) are placed inside it during the manufacturing process and are connected to the outside by means of holes or ventilation channels (5). According to the size of the mattress, the number of clay discs applied is preferable sixty-five (double mattress) or forty-five (single mattress).

The rigidity of the mattress resulting from the latex-type polyurethane foam, as mentioned above, allows for perfect posture of the vertebral column in a dorsal or lateral recumbent position, thus guaranteeing decompression of the vertebral discs, which is an essential factor for combating spondylitis.

The pillow and the mattress that are the subject of the invention are manufactured using a latex-type polyurethane injection process in a mould suitable for obtaining the desired final shape.

The clay discs are duly supported by metallic pillars which are situated in the centre of the mould and form an integral part thereof. Using this process, after completing the injection, the discs are automatically placed inside the pillow and are connected to the outside by means of holes or channels formed by the metallic pillows. These channels are created when the pillow is removed from the respective mould.

As mentioned above, the injected foam is made of a latex-type polyurethane, which does not contain TDI (toluene diphenyl di-isocyanate), HCFCs (hydrochlorofluorocarbons) or CFCs (chlorofluorocarbons) and has an internal density which complies with the DIN standard 53428 of 45 to 51 $Kg/m^3$, 40% compression in accordance with DIN standard 53577 of 4.5 to 7.1 Kpa, traction resistance in accordance with DIN standard 53571A of 110 to 135 Kpa, expansion in accordance with DIN standard 53571A of 90% to 101%, residual deformation in accordance with DIN standard 53572 of 8% to 9%, tear resistance in accordance with DIN standard 53575 of 4.0 to 5.8 N/cm and is anti-allergic and non-flammable. The clay disc is purified at over 100° C.

As is obvious to persons skilled in the art, various alterations can be made to the preferred embodiment of the model which is described above and is shown in the drawings. These slight alterations must be considered to fall within the scope of the invention as defined by the claims attached hereto.

I claim:

1. An anatomical member support comprising:

a base having a top for receiving the supported anatomical member and a bottom, the base being formed from a material shaped to provide correct support and positioning to the anatomical member, the base defining one or more interior channels passing from the top to the bottom, and;

one or more clay discs disposed, generally, horizontally between the top and bottom of the base, and in fluid connection with the interior channels so that moisture can pass through the channel to be absorbed by the clay discs.

2. An anatomical support as claimed in claim 1, wherein, said base is shaped to support the head and neck.

3. An anatomical support as claimed in claim 2, wherein said base contains three interior channels and one or more clay discs disposed in each of said channels.

4. An anatomical support as claimed in claim 1, wherein said base is composed of essentially a polyurethane foam.

5. An anatomical support as claimed in claim 2, wherein said base is composed of essentially a polyurethane foam.

6. An anatomical support as claimed in claim 3, wherein said base is composed of essentially a polyurethane foam.

7. An anatomical support as claimed in claim 1, wherein said anatomical support is a full body support.

8. An anatomical support as claimed in claim 7, wherein said base contains 45 to 65 interior channels and one or more clay discs disposed in each of said channels.

9. An anatomical support as claimed in claim 7, wherein said base is composed of essentially a polyurethane foam.

10. An anatomical support as claimed in claim 8, wherein said base is composed of essentially a polyurethane foam.

11. An anatomical support as claimed in claim 1, 2, 3, 4, 5, 6, 7, 8, 9, or 10 wherein the base and interior channels have a waterproof surface.

* * * * *

UNITED STATES PATENT AND TRADEMARK OFFICE

CERTIFICATE OF CORRECTION

PATENT NO. : 5,884,351

DATED : March 23, 1999

INVENTOR(S) : Sanna Tonino

It is certified that error appears in the above-identified patent and that said Letters Patent is hereby corrected as shown below:

On the title page, after "[22] Filed: Nov. 7, 1997", please insert --[30] Foreign Application Priority Data
Apr. 11, 1997 [PT] Portugal 9373--

Signed and Sealed this

Third Day of August, 1999

*Attest:*

Q. TODD DICKINSON

*Attesting Officer*

*Acting Commissioner of Patents and Trademarks*